US007344379B2

(12) United States Patent
Marmaropoulos et al.

(10) Patent No.: US 7,344,379 B2
(45) Date of Patent: Mar. 18, 2008

(54) MAGNETIC ELECTRICAL INTERCONNECT

(75) Inventors: George Marmaropoulos, Yorktown Heights, NY (US); Giang Truong Vu, New York, NY (US); Jack Kyriakos Mama, London (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/566,759

(22) PCT Filed: Aug. 6, 2004

(86) PCT No.: PCT/IB2004/051417

§ 371 (c)(1),
(2), (4) Date: Jan. 31, 2006

(87) PCT Pub. No.: WO2005/013738

PCT Pub. Date: Feb. 17, 2005

(65) Prior Publication Data

US 2006/0252284 A1 Nov. 9, 2006

Related U.S. Application Data

(60) Provisional application No. 60/494,135, filed on Aug. 11, 2003.

(51) Int. Cl.
*H01R 33/00* (2006.01)

(52) U.S. Cl. ..... 439/37; 439/39

(58) Field of Classification Search ..... 439/37–39, 439/913

See application file for complete search history.

(56) References Cited

U.S. PATENT DOCUMENTS

| | | | | |
|---|---|---|---|---|
| 1,827,940 | A * | 10/1931 | Greenwood | 335/195 |
| 3,181,895 | A * | 5/1965 | Cator | 285/1 |
| 3,431,428 | A * | 3/1969 | Valer | 307/10.1 |
| 5,954,520 | A * | 9/1999 | Schmidt | 439/39 |
| 6,561,814 | B2 * | 5/2003 | Tilbury et al. | 439/37 |
| 6,563,424 | B1 * | 5/2003 | Kaario | 340/572.1 |

FOREIGN PATENT DOCUMENTS

| | | |
|---|---|---|
| DE | 4104098 | 8/1991 |
| DE | 10005748 | 8/2001 |
| EP | 0338105 | 10/1989 |
| NL | 228231 | 3/1965 |
| WO | WO199416587 | 8/1994 |
| WO | WO200249465 | 6/2002 |

* cited by examiner

*Primary Examiner*—Tho D. Ta
*Assistant Examiner*—Travis Chambers

(57) ABSTRACT

A garment 20 includes magnetic interconnects 21 which serve to form mechanical connections to close garment 20 as well as to form electrical connections, for example, between power source 4 and a device 7. Interconnects 21 are formed by a first portion 22 and a second portion 23 which form a mechanical connection via magnetic attraction. First 22 and second 23 portions can be quickly coupled and decoupled and contain all the advantages of magnetic couplings, including ease of connection and simplicity of design.

6 Claims, 9 Drawing Sheets

MAGNETIC ELECTRICAL INTERCONNECT

CROSS REFERENCE TO RELATED APPLICATION

This application claims the benefit of U.S. provisional application Ser. No. 60/494,135 filed Aug. 11, 2003, which is incorporated herein by reference.

The present invention relates generally to wearable electronics, and more particularly, to a magnetic electrical interconnect integrated for use in wearable electronic applications.

Wearable electronics involves the integration of electronic items with fabric and garments. Examples of these are personal stereos, heart rate monitors, bio-feedback sensors, telephone headsets, data line connections, microprocessors, computerized components, etc.

Fabrics including conductive fibers are also commonly known in the art Such fabrics include fibers interwoven with textile fibers to create circuits. Current can be selectively passed to an area on such fabric using a switch and a power source. FIG. 1 depicts a garment 2 that includes conductive fibers. Garment 2 has three current paths 3, 3', 3" that are made up of conductive fibers through which current can be passed from power source 4. Current paths can also be formed using other known techniques such as conductive ink. Garment 2 also includes a switch 5 that the wearer of the garment can select which current path he or she chooses. For example, a user can attach a portable electronic device, such as a cellular telephone or portable radio, to garment 2 at clip 6. When the wearer sets switch 5 to power the electronic device, current passes from power source 4 through current path 3" to clip 6 and into the attached device. The conductive fibers that make up current paths 3, 3', and 3" can also be selected to have a high resistance. Consequently, they act as resistors and release electrical energy as heat. Current paths 3, 3', and 3" can be used to heat garment 2 in selected areas. However, these fabrics require additional electrical connections integrated into their basic functionality, such as at a button closure of a jacket.

WO 94/16587, entitled CLOSURE FOR A GARMENT OR THE LIKE, filed Jan. 25, 1994, describes a closure for a garment intended to replace buttons and buttonholes with a magnet/ferromagnetic closure. This closure can be rotated to make or break a magnetic circuit and thereby open or close a garment. However, the magnetic circuit does not include means for forming an electrical connection.

WO 02/49465 A1, entitled PORTABLE ELECTRONIC EQUIPMENT, filed Dec. 13, 2001, describes a clothing article with a network of transmission lines integrated into the textile material. The transmission lines can include a switch made from a connector, such as a button. However, this disclosure only recites a button or snap connection that lacks the reliability of mechanical connection suitable to maintain a desirably consistent electrical connection. Further, both portions of the button/buttonhole or snap connection must be conductive to enable an electrical connection.

It is an object of the present invention to provide an improved fabric interconnect and method for controlling an attached electronic device which overcomes the limitations of the prior art.

It is another object of the present invention to provide such a fabric interconnect method that ensures mechanical and electrical connection.

In one aspect, an interconnect provides an improved fabric interconnect by including several portions. A first portion includes a magnet with a first magnetic direction and means for forming an electrical connection. A second portion includes means for forming an electrical connection when coupled with the first portion. The first and second portions form a mechanical connection and an electrical connection when connected.

In one embodiment, the first portion and second portion form a mechanical connection using magnetic attraction generated by the magnet In another embodiment, the second portion further comprises a magnet with a second magnetic direction.

In another embodiment, the electrical connection is aligned by the mechanical connection. In another embodiment, the electrical connection is aligned by the mechanical connection and a physical feature of the first and/or second portions.

In one embodiment, the first and second portions include means for mechanically connecting fabric materials. In another embodiment, the first and second portions receive electric current from a current supply source via fabric conductors contained within the fabric materials. In another embodiment, the first and second portions form an electrical circuit when mechanically connected. In another embodiment, the electrical circuit passes current from one location on a fabric material to another location on a fabric material. In another embodiment, the electrical circuit passes electrical signals from one location on a fabric material to a device.

In one embodiment, the means for forming an electrical connection includes a male connector or a female receptor. In another embodiment, the means for forming an electrical connection includes a surface contact. In another embodiment, the means for forming an electrical connection of the first or second portion includes the magnet.

In another aspect, an interconnect includes several portions. A first portion includes an electromagnet and means for forming an electrical connection. The interconnect also includes means for supplying current to the electromagnet and a second portion including means for forming a electrical connection when coupled with the first portion. The first and second portions form a mechanical connection upon the electromagnet receiving current and further form an electrical connection when mechanically connected.

In one embodiment, the means for supplying current includes an electronic device. In another embodiment, the electronic device is a wearable electronic device. In another embodiment, the second portion further includes a magnet. In another embodiment, the magnet is an electromagnet. In another embodiment, the second portion includes a substance attracted by a magnet.

In another aspect, a method of controlling a device includes several steps. One step is coupling at least one interconnect in a series of interconnects, each including a first portion comprising a magnet with a first magnetic direction and means for forming an electrical connection and a second portion including means for forming a electrical connection when coupled with the first portion, wherein the first and second portions form a mechanical connection and an electrical connection when connected. Another step is sensing the coupling of the at least one interconnect. Another step is controlling the device based upon the number of coupled or uncoupled interconnects in the series of interconnects.

In one embodiment, the sensing step further includes sensing when an electrical circuit is formed by the coupling step. In another embodiment, the controlling step includes incrementally controlling the device based upon the number of coupled or uncoupled interconnects.

In one embodiment, the device is a heating element contained in a garment, and the at least one interconnect is attached to the garment.

The invention provides many advantages that are evident from the following description, drawings, and claims.

The invention may be more completely understood in reference to the following figures.

Figure 1:
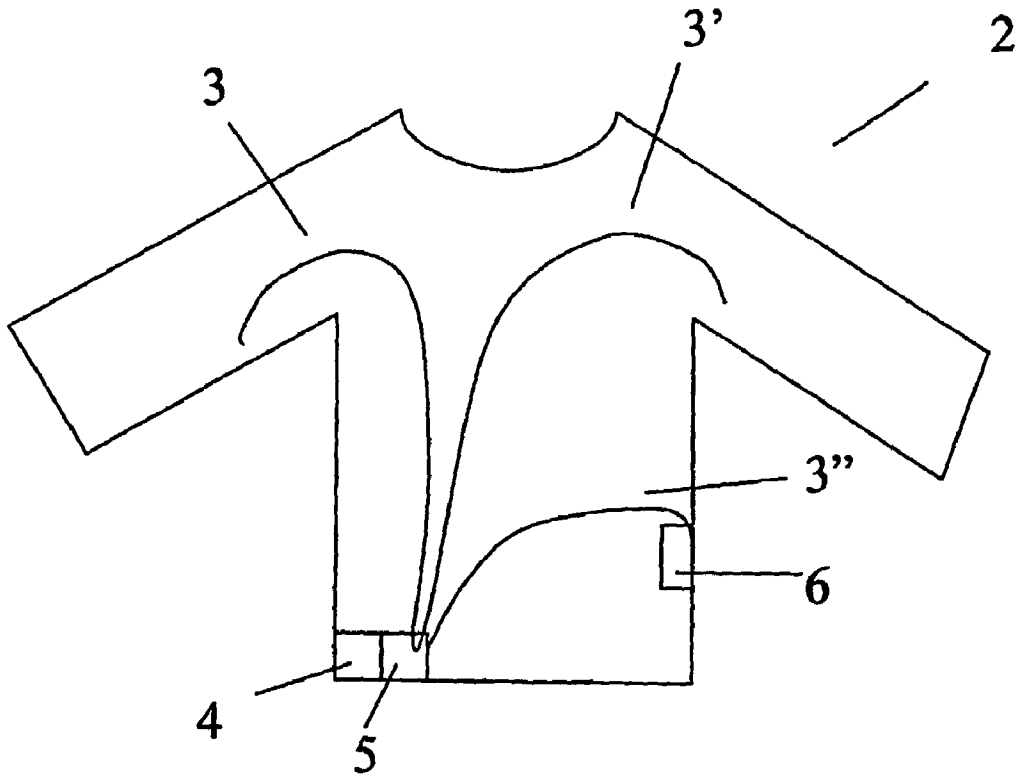
Fig. 1 PRIOR ART
FIG. 1 depicts a prior art garment including conductive fibers.
Figure 2:
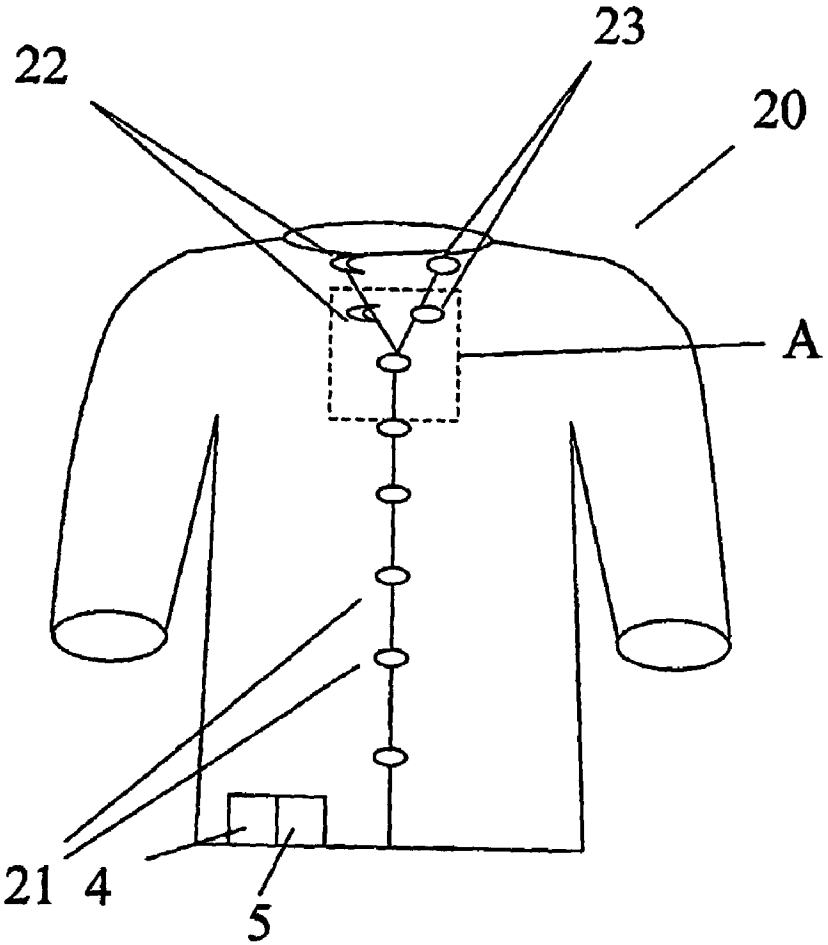
FIG. 2 depicts a garment including magnetic electrical/mechanical interconnects.

FIG. 2 depicts a garment 20 including magnetic interconnects 21 which serve to form mechanical connections to close garment 20 as well as to form electrical connections, for example, between power source 4 and a device 7. Interconnects 21 are formed by a first portion 22 and a second portion 23 which form a mechanical connection via magnetic attraction. First (22) and second (23) portions can be quickly coupled and decoupled and contain all the advantages of magnetic couplings, including ease of connection and simplicity of design.

Figure 3:
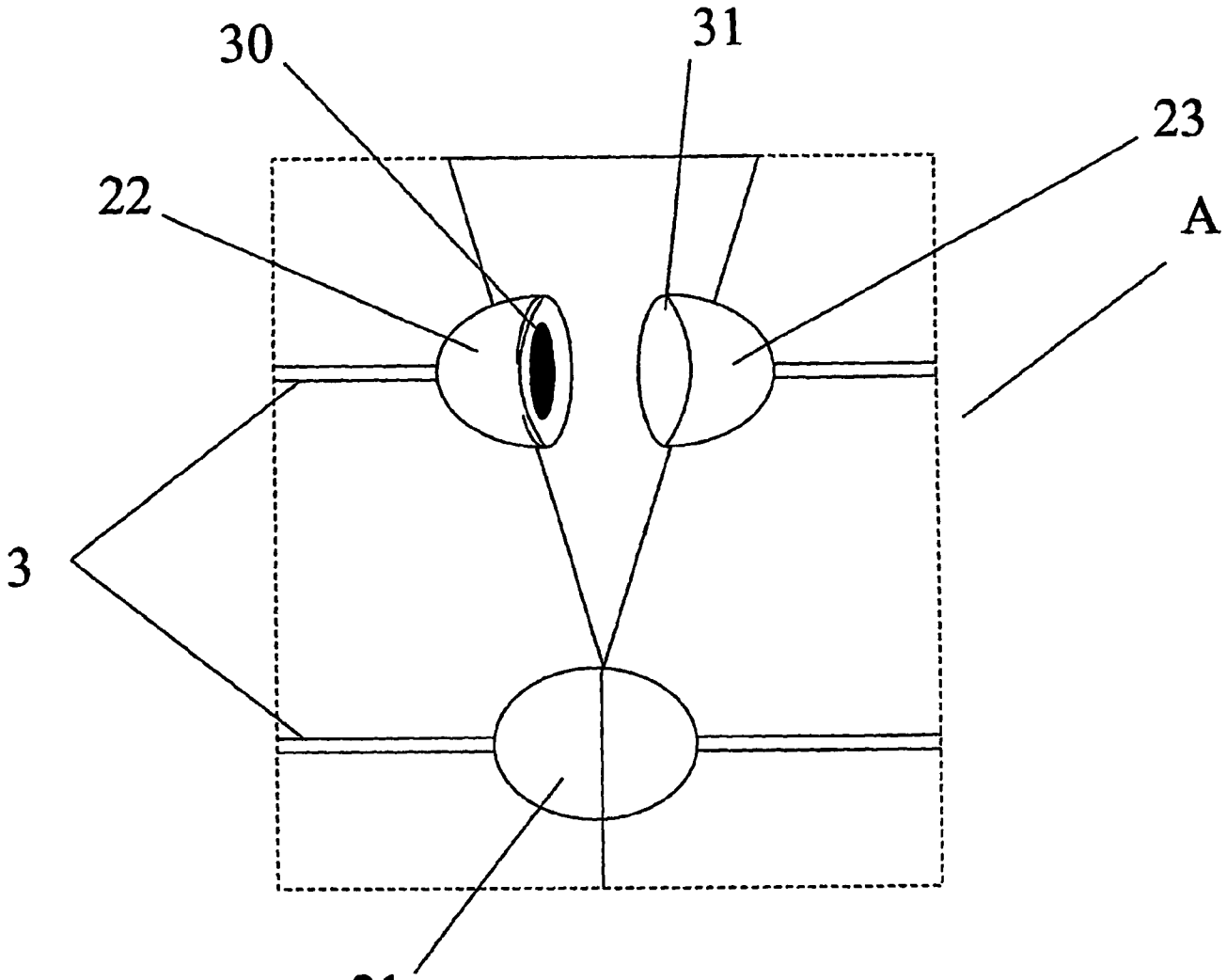
FIG. 3 depicts an expanded view of portion A of FIG. 2.

FIG. 3 depicts an expanded view of portion A of FIG. 2. As shown in this view, interconnect 21 is formed by connecting first portion 22 and second portion 23. The mechanical coupling of interconnect 21 is generated by magnet 30 which is embedded in first portion 22. Magnet 30 can be any type of substance which generates a magnetic field and thereby attracts another substance. Second portion 23 has at least one substance 31, either on its surface or contained within it, that is attracted by magnet 30. The magnetic force generated by magnet 30 attracting substance 31 must be at least mechanically strong enough to secure garment 20 from opening under reasonable force, but not so strong that a wearer of garment 20 cannot decouple the connection.

First 22 and second 23 portions are each electrically connected to current paths 3 that can be made up of conductive fibers through which current can be passed from power source 4. Current paths 3 can also be formed using any other technique known in the art, such as conductive ink. When mechanically connected, first 22 and second 23 portions form interconnect 21. Additionally, the surfaces of first 22 and second 23 portions contain electrical contacts that complete a circuit when the mechanical connection of interconnect 21 presses them together. Magnet 30, itself, can be the means for forming an electrical connection.

Figure 4:
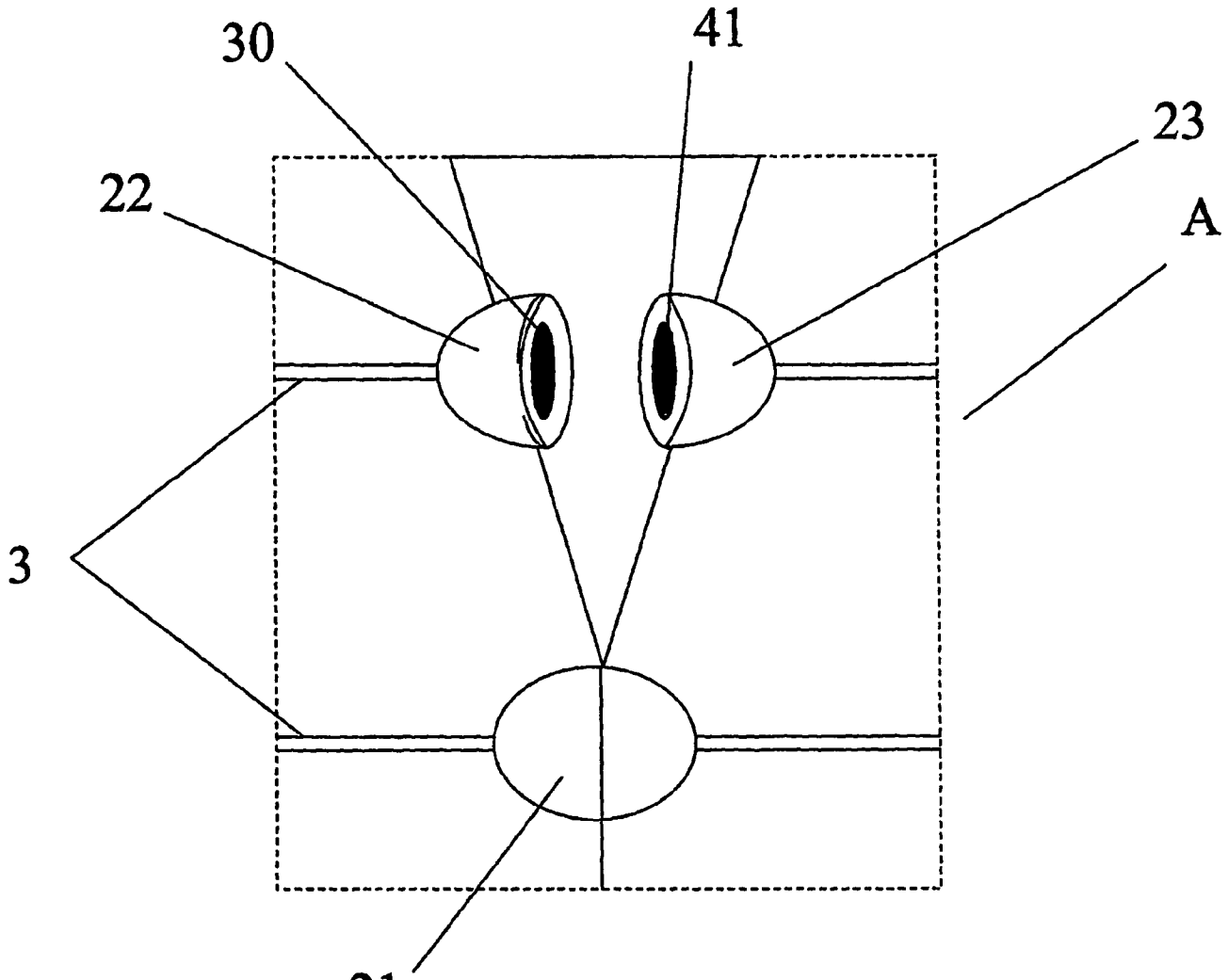
FIG. 4 depicts a further embodiment of the interconnect.

FIG. 4 depicts an alternate embodiment of the interconnect of FIG. 3. In this embodiment, both fist 22 and second portions 23 contain magnets 30, 41, respectively. The magnets 30, 41 may contain opposite magnetic directions, thereby causing the magnetic attraction and mechanical coupling of interconnect 21. Additionally, one or both of magnets 30, 41 can be an electromagnet powered by a source, such as power source 4. If, for example, first portion 22 contains an electromagnet, it would attract second portion 23 upon receiving current, thereby activating a magnetic field. Such a configuration is useful for automated interconnection of interconnects 21. A wearer of garment 20 could, for example, press a button and thereby initiate activation of selected electromagnets 30 contained in selected first portions 22. These first portions 22 would attract their respective second portions 23 and thus automatically both close the garment and form electrical connections.

Figure 5:
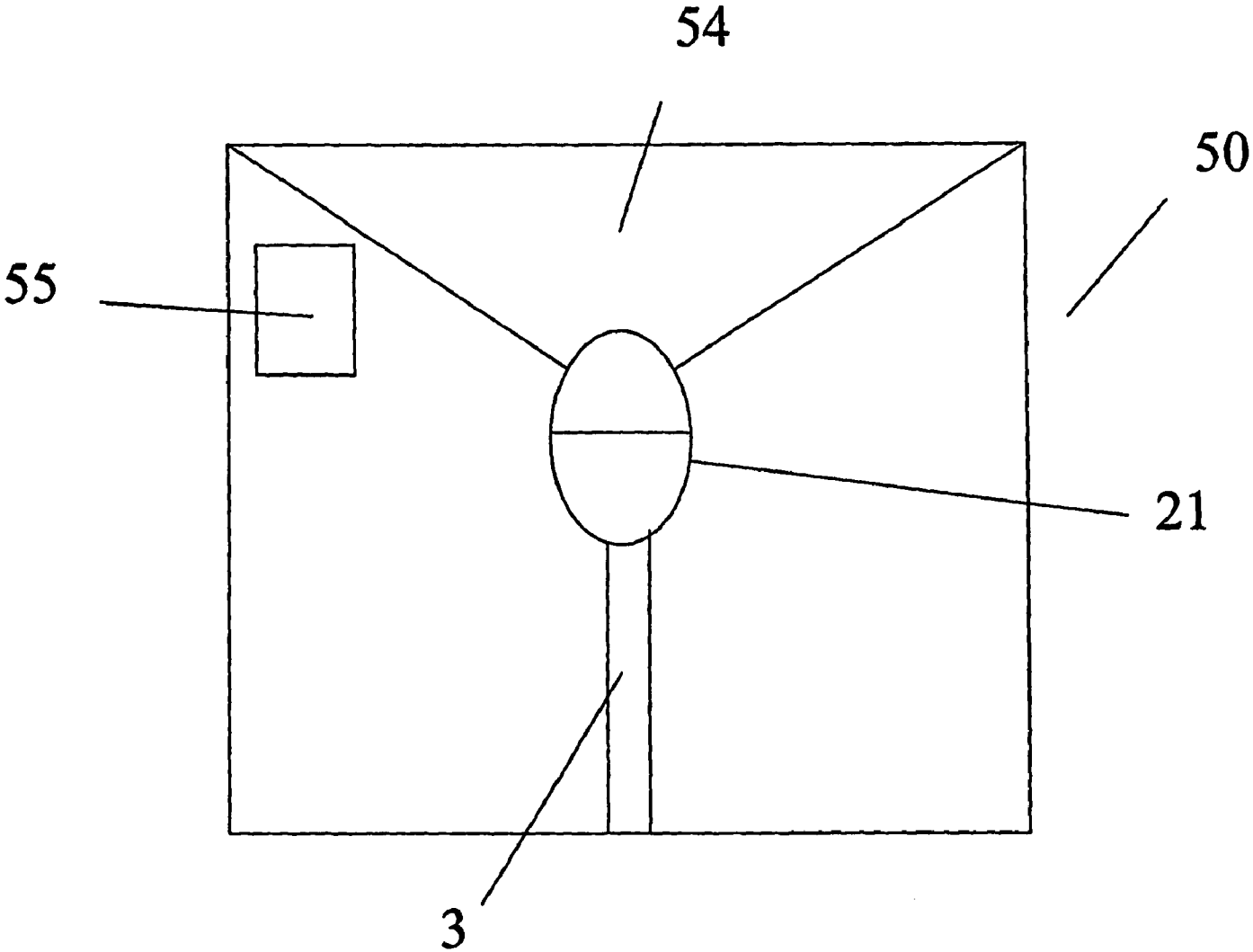
FIG. 5 depicts an interconnect for securing a device to a garment.

Further, such interconnects including electromagnets could be used to secure devices to garment 20. For example, FIG. 5 shows a garment 20 including a pocket 50 in which a wearable electronic device 7 is held. The current path can be structured within garment 20 such that activating switch 55 and switching device 7 off would cut off power to an electromagnet contained in an interconnect 21 used to secure the pocket. Cutting off power to the electromagnet with eliminate its magnetic field and thereby release both the mechanical and electrical connection of interconnect 21. Thus, turning off device 7 will release the interconnect 21 that closes the pocket 50 in which device 7 is held. Flap 54 of pocket 50 will not be mechanically held in place. Conversely, activating device 7 by switching switch 55 to on will supply current to the electromagnet that will generate a magnetic field. This will attract the other portion of interconnect 21 and form an electrical and mechanical connection automatically, thus securing device 7 to garment 20.

Figure 6:
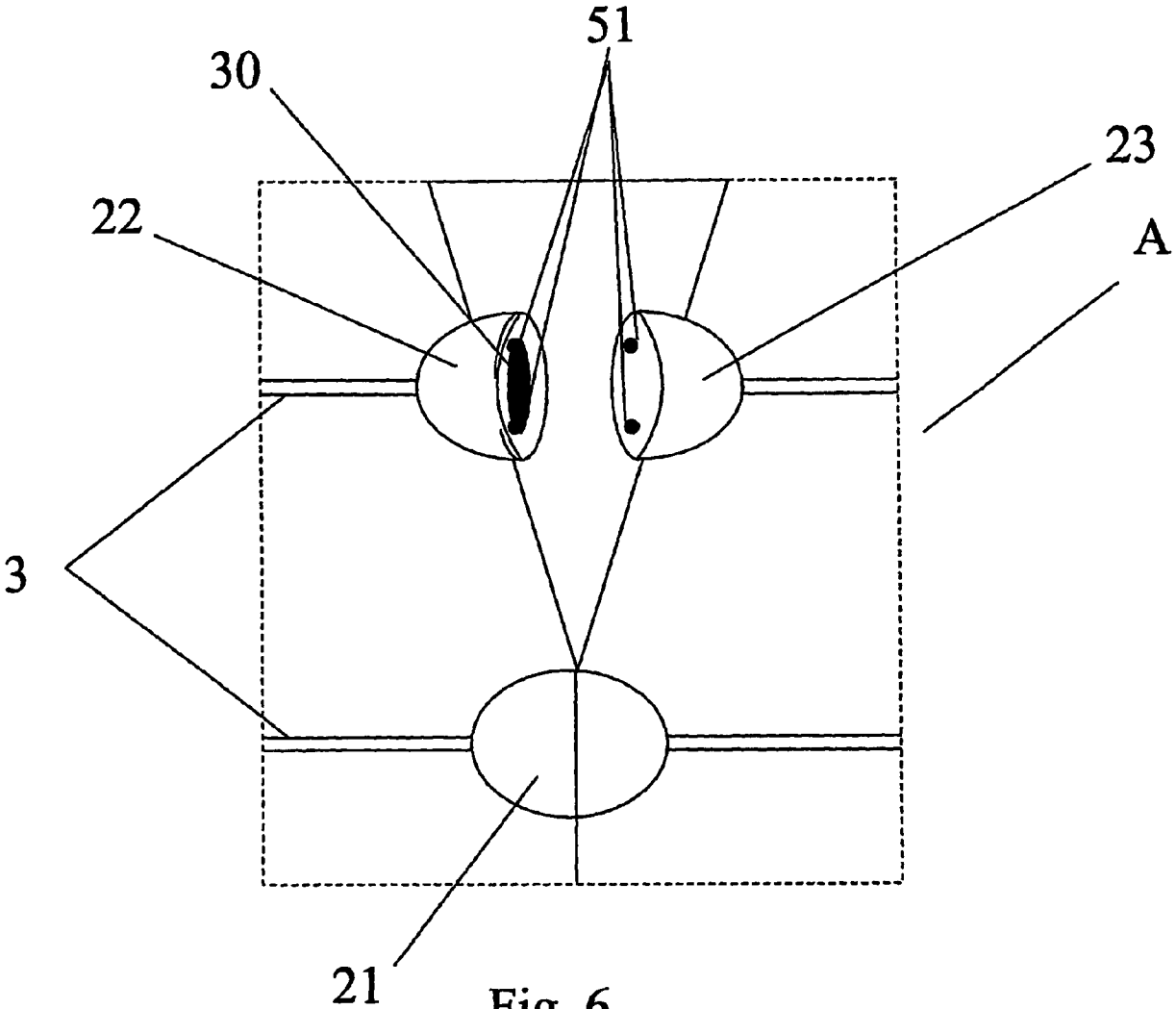
FIG. 6 depicts a further embodiment of the interconnect.

FIG. 6 shows an additional embodiment of the interconnect 21 where first portion 22 and second portion 23 contain electrical contact pads 51. When first portion 22 is mechanically connected to second portion 23, contact pads 51 are aligned to provide an electrical connection as well.

Figure 7:
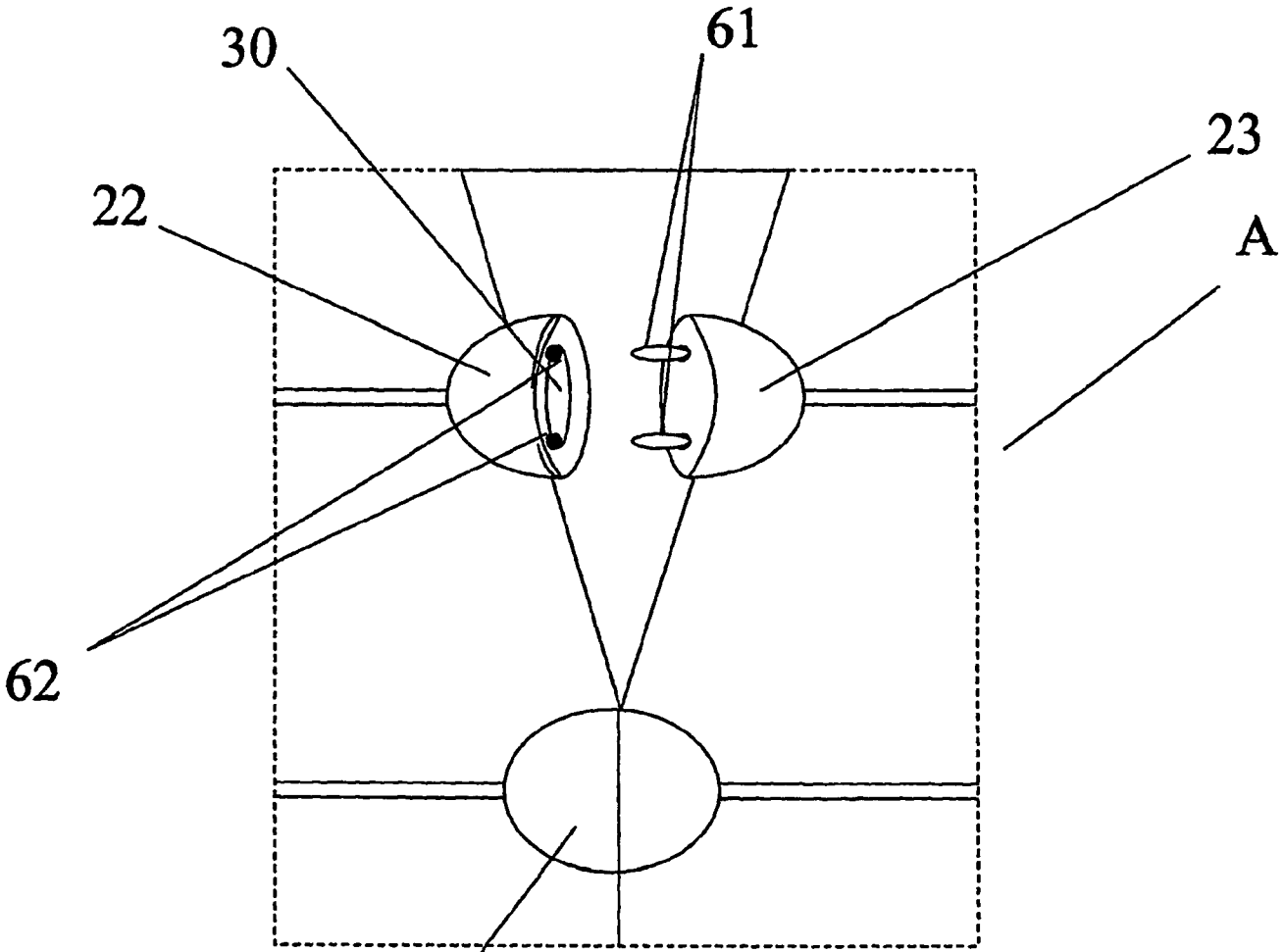
FIG. 7 depicts a further embodiment of the interconnect.

FIG. 7 shows an additional embodiment of the interconnect 21 where first portion 22 contains female sockets 62 and second portion 23 contains male connectors 61. When first portion 22 is mechanically connected to second portion 23, male connectors 61 are aligned with and inserted into female sockets 62, thereby forming an electrical connection.

Figure 8:
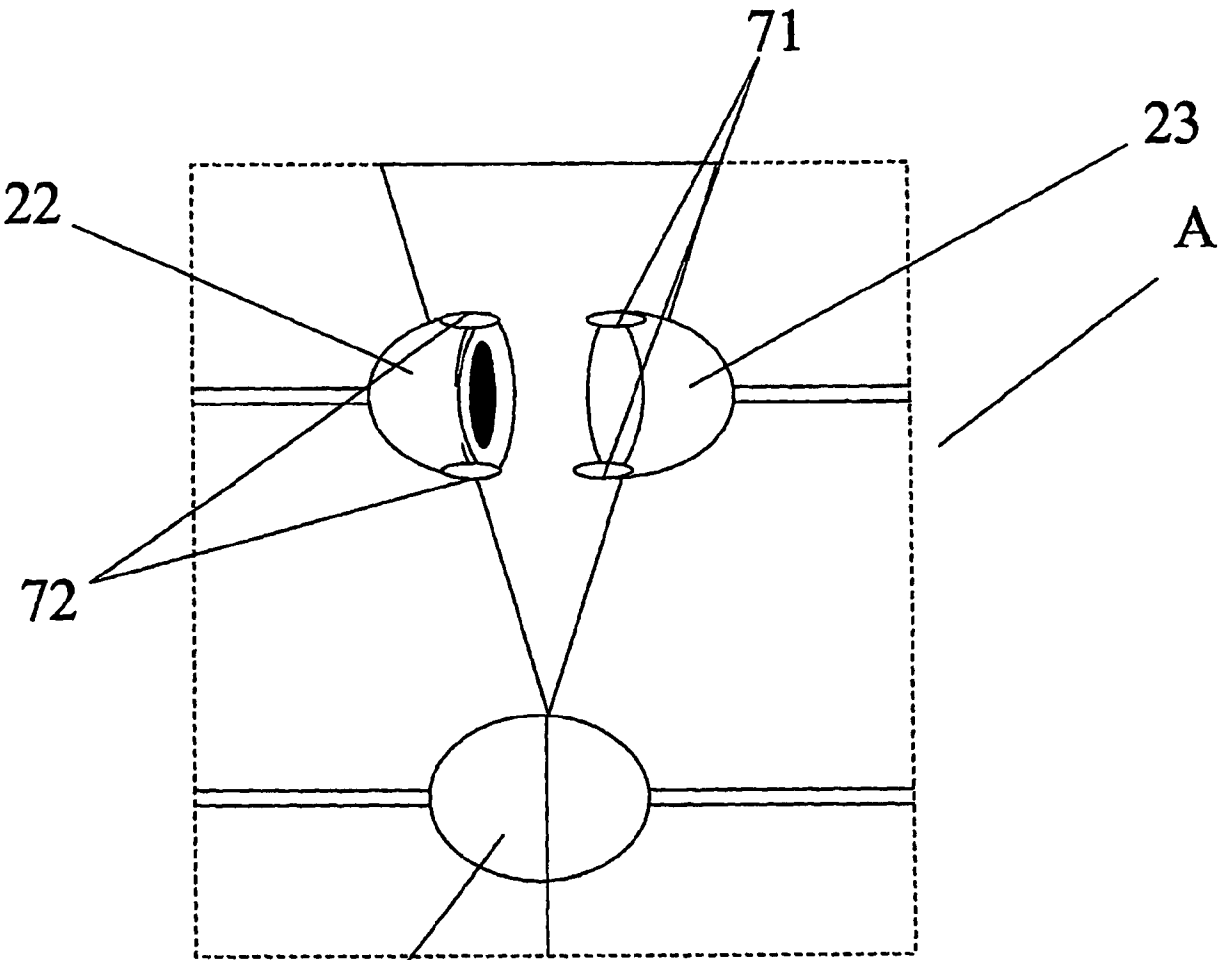
FIG. 8 depicts a further embodiment of the interconnect.

FIG. 8 shows an additional embodiment of the interconnect 21 where first portion 22 contains indents 72 and second portion 23 contains extensions 71. When first portion 22 is mechanically connected to second portion 23, indents 72 and extensions 71 aligned first portion 22 and second portion 23 to provide an optimized mechanical and electrical connection. Any physical feature may be used to assist in aligning first portion 22 and second portion 23 in forming interconnect 21.

Figure 9:
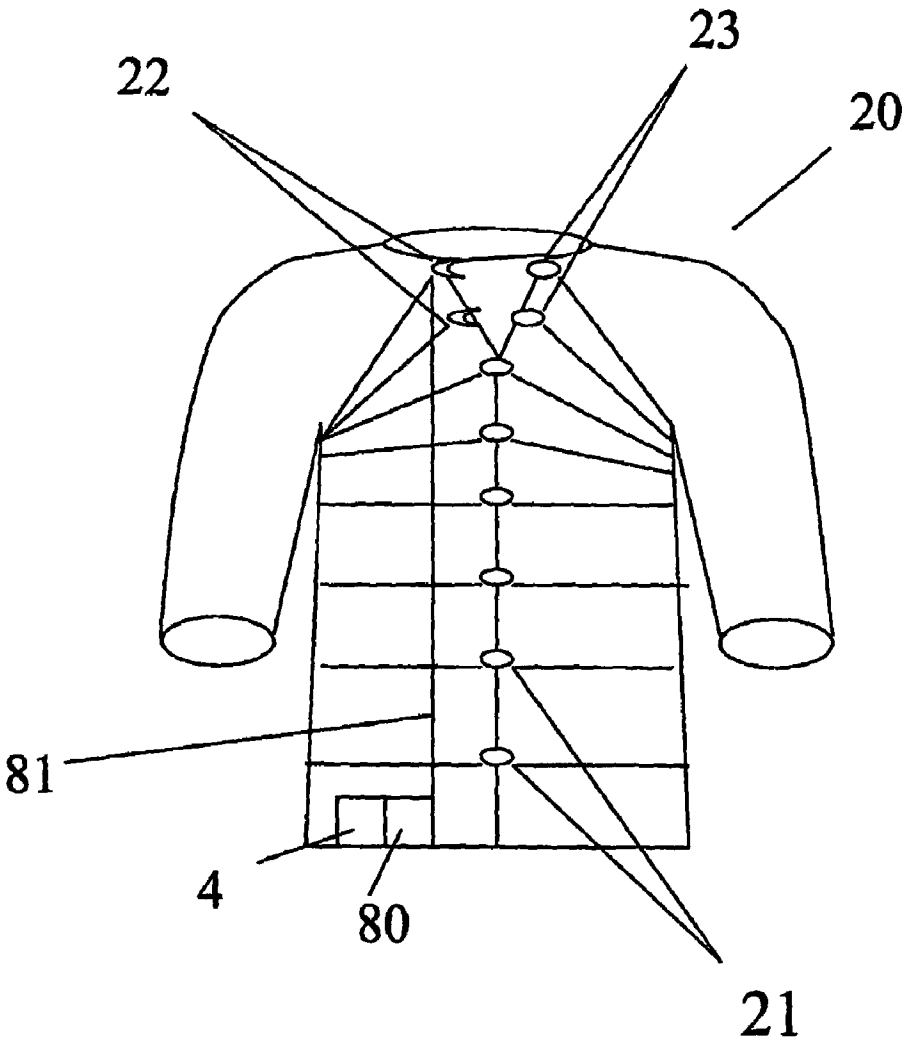
FIG. 9 depicts a garment for controlling a device based on the number of connected interconnects.

FIG. 9 depicts garment 20 designed to control attached device 80. Device 80 includes sensor 81 which senses the coupling or decoupling of each interconnect 21. Sensor 81 detects when an interconnect 21 is coupled by detecting current flow through the electrical connection of interconnect 21. Device 80 is controlled based on the number of coupled or uncoupled interconnects 21 in the series of interconnects 21. Device 80 can be a heating device which will increase or decrease the heat it produces incrementally as the wearer couples or decouples individual interconnects 21.

The preceding expressions and examples are exemplary and are not intended to limit the scope of the claims which follow. Further, reference signs in the claims cannot be construed as limiting their scope.

What is claimed is:

1. An interconnect (21) in a series of interconnects of a garment, the interconnect comprising:

a first portion (22) including a magnet (30) with a first magnetic direction and means for forming an electrical connection; and a second portion (23) comprising means for forming an electrical connection when coupled with the first portion, wherein the first (22) and second (23) portions form a mechanical connection and an electrical connection when connected, the garment further including:

a sensor for sensing a coupling of the interconnect in the series of interconnects, wherein the sensor senses a current flow through the electrical connection of the interconnect; and an attachable device, wherein the attachable device comprises a heating device adapted to be incrementally controlled to increase or decrease heat produced by the heating device in response to a number of coupled or uncoupled individual interconnects in the series of interconnects sensed by the sensor.

2. The interconnect (21) of claim 1, wherein the second portion (23) further comprises a magnet (41) with a second magnetic direction.

3. The interconnect (21) of claim 1, wherein the first portion (22) and second (23) portion form the mechanical connection using magnetic attraction generated by the magnet (30).

4. The interconnect (21) of claim 3, wherein the electrical connection is aligned by the mechanical connection.

5. The interconnect (21) of claim 1, wherein the means for forming an electrical connection of the first (22) or second (23) portion comprises the magnet (30).

6. A garment (20) comprising:

a series of interconnects, each interconnect comprising:

a first portion (22) including a magnet (30) with a first magnetic direction and means for forming an electrical connection; and a second portion (23) comprising means for forming an electrical connection when coupled with the first portion, wherein the first (22) and second (23) portions form a mechanical connection and an electrical connection when connected, the garment further comprising:

a sensor for sensing a coupling of each interconnect in the series of interconnects, wherein the sensor senses a current flow through the electrical connection of the interconnect; and an attachable device, wherein the attachable device comprises a heating device adapted to be incrementally controlled to increase or decrease heat produced by the heating device in response to a number of coupled or uncoupled individual interconnects in the series of interconnects sensed by the sensor.

* * * * *